US005385348A

United States Patent [19]

Wargo

[11] Patent Number: 5,385,348

[45] Date of Patent: Jan. 31, 1995

[54] METHOD AND SYSTEM FOR PROVIDING CUSTOM DESIGNED GOLF CLUBS HAVING REPLACEABLE SWING WEIGHT INSERTS

[76] Inventor: Elmer Wargo, 10080 Mallett Dr., Spring Valley, Ohio 45370

[21] Appl. No.: 151,943

[22] Filed: Nov. 15, 1993

[51] Int. Cl.[6] ..... A63B 53/04

[52] U.S. Cl. ..... 273/171; 273/77 A

[58] Field of Search ..... 273/167 F, 169, 170, 273/171, 172, 173, 174, 194 B, 162 R, 77 R, 77 A, 164.1, 167 R, 167 H

[56] References Cited

U.S. PATENT DOCUMENTS

| | | | |
|---|---|---|---|
| 2,198,981 | 4/1940 | Sullivan | 273/171 |
| 3,075,768 | 1/1963 | Karns | 273/171 X |
| 3,606,327 | 9/1971 | Gorman | 273/171 |
| 3,897,066 | 7/1975 | Belmont | 273/171 |
| 4,052,075 | 10/1977 | Daly | 273/171 |
| 4,180,269 | 12/1979 | Thompson | 273/171 |
| 4,313,607 | 2/1982 | Thompson | 273/171 |
| 4,326,326 | 4/1982 | MacDonald | 273/167 F |
| 4,655,459 | 4/1987 | Antonious | 273/171 |
| 4,811,949 | 3/1989 | Kobayashi | 273/171 |
| 4,867,458 | 9/1989 | Sumikawa | 273/167 H X |
| 4,869,507 | 9/1989 | Sahm | 273/167 H |
| 5,013,041 | 5/1991 | Sun | 273/171 |

FOREIGN PATENT DOCUMENTS 2337985 2/1975 Germany ..... 273/170

OTHER PUBLICATIONS

Messers. A. Cochran and J. Stobbs, *The Search for the Perfect Swing*, J. B. Lippincott Co., Philadelphia and New York, 1968, p. 208.

*Primary Examiner*—Sebastiano Passaniti
*Attorney, Agent, or Firm*—Elmer Wargo

[57] ABSTRACT

A method and system for providing custom designed golf clubs having replaceable swing weight inserts therein. The associated club head has a receiving area thereon for receiving an insert which is installed on the club. A set of clubs is designed to have a minimum swing weight and a plurality of inserts are supplied to alter the swing weight of individual clubs in the set. When two such inserts are placed on the toe and heel portions of the club head, the replaceable inserts can be altered to provide temporary cures for "slicing" and "hooking" problems associated with the golfer using the clubs. The replaceable inserts have their weights and characteristics varied by controlling the amounts and locations of a layer of weighty material attached thereto.

13 Claims, 3 Drawing Sheets

METHOD AND SYSTEM FOR PROVIDING CUSTOM DESIGNED GOLF CLUBS HAVING REPLACEABLE SWING WEIGHT INSERTS

BACKGROUND OF THE INVENTION

1. Field of Invention

This invention relates to a method and system for providing custom designed golf clubs having replaceable swing weight inserts.

2. Background Information

One of the problems facing golfers who wish to purchase golf clubs is that it is difficult to anticipate what type of golf clubs an individual golfer will need. There are many factors which affect the selection of a particular set of clubs. Some of these factors are:

1. Swing weight for the club.
2. Stiffness of the shaft.
3. Material of the shaft (steel or graphite, for example).
4. Length of the shaft and its associated flex point along the length of the shaft.
5. Toe and heel weighting of the club head or the absence thereof.
6. Type of grip.
7. Square grooves on the clubface or not.
8. Overall weight of the club.
9. Overall "feel" of the club.
10. Price of the club.
11. Esthetics or the appearance of the club.

In addition to the factors mentioned, the problem of selecting clubs is made more difficult by the fact that golfers would like to try out the clubs in actual play before purchasing the clubs; however, most golf shops selling the clubs do not permit golfers to try a whole set of clubs, like irons, for example, in actual play before buying the set. It is understandable why golfers are hesitant about buying new clubs.

Recently, there has been a trend for golfers to have their clubs custom made. The process includes selecting club heads, shafts, and grips and having them assembled locally in a custom golf shop. If one selects a "standard" club head and then selects a shaft length which is longer than "standard", it is conceivable that the overall swing weight of the club may be a little "heavier" than what was expected. For example, if a standard club head and a standard shaft length produce a club having a swing weight of D2, a club made with a shaft length one inch longer than standard may produce a club having a swing weight of D4. This "heavier" swing weight may not match the swinging characteristics of the golfer purchasing the club.

Another problem is that even if one starts out with golf clubs having the desired swing weight, the swing weight may not work out to be the correct swing weight in actual play with the club or clubs.

SUMMARY OF THE INVENTION

An object of this invention is to obviate the problems mentioned in the Background of the Invention.

Another object of this invention is to provide a method and system for providing a simple, low cost way of changing the swing weight of a particular club.

A feature of this invention is that it provides a low cost way of changing the "toe" and "heel" weight characteristics of a club so as to assist a golfer in changing the flight of the ball if the golfer habitually slices or hooks the ball as the result of an improper swing.

Another feature of this invention is that it can be used to change the weighting of the club head so as to assist a golfer who has difficulty in getting the ball airborne as a result of improper hitting.

In one aspect of this invention there is provided a golf club having a grip, a shaft, and a club head;

said club head having at least one receiving area thereon for receiving a replaceable insert to provide a swing weight for said club when said replaceable insert is inserted in said receiving area; and at least one replaceable insert selected from a group of replaceable inserts having predetermined designated weights to alter the swing weight of the club when said at least one replaceable insert is inserted in said at least one receiving area.

In another aspect of this invention, there is provided a combination of a set of golf clubs and a group of replaceable inserts, each said golf club comprising:

a grip;

a shaft; and a club head having a receiving area thereon for receiving a replaceable insert;

each said golf club within said set having a first predetermined swing weight; and said group of replaceable inserts having a variety of weights to vary said first predetermined swing weight of an individual club within said set when an insert from said group of replaceable inserts is mounted in said receiving area of said individual club.

In yet another aspect of this invention there is provided a method of providing a golf club having a variety of swing weights comprising the steps of:

(a) providing a club head for the golf club with at least one receiving area therein to receive a replaceable insert therein;

(b) providing a plurality of replaceable inserts, with each said replaceable insert having a predetermined amount of weighty material attached thereto for affecting the swing weight of the golf club; and (c) selecting one of said replaceable inserts to be installed in said receiving area to enable the golf club to attain the desired swing weight.

The above advantages, and others, will be more readily understood in connection with the following specification, claims, and drawing.

DETAILED DESCRIPTION OF THE PREFERRED EMBODIMENT

Figure 1:
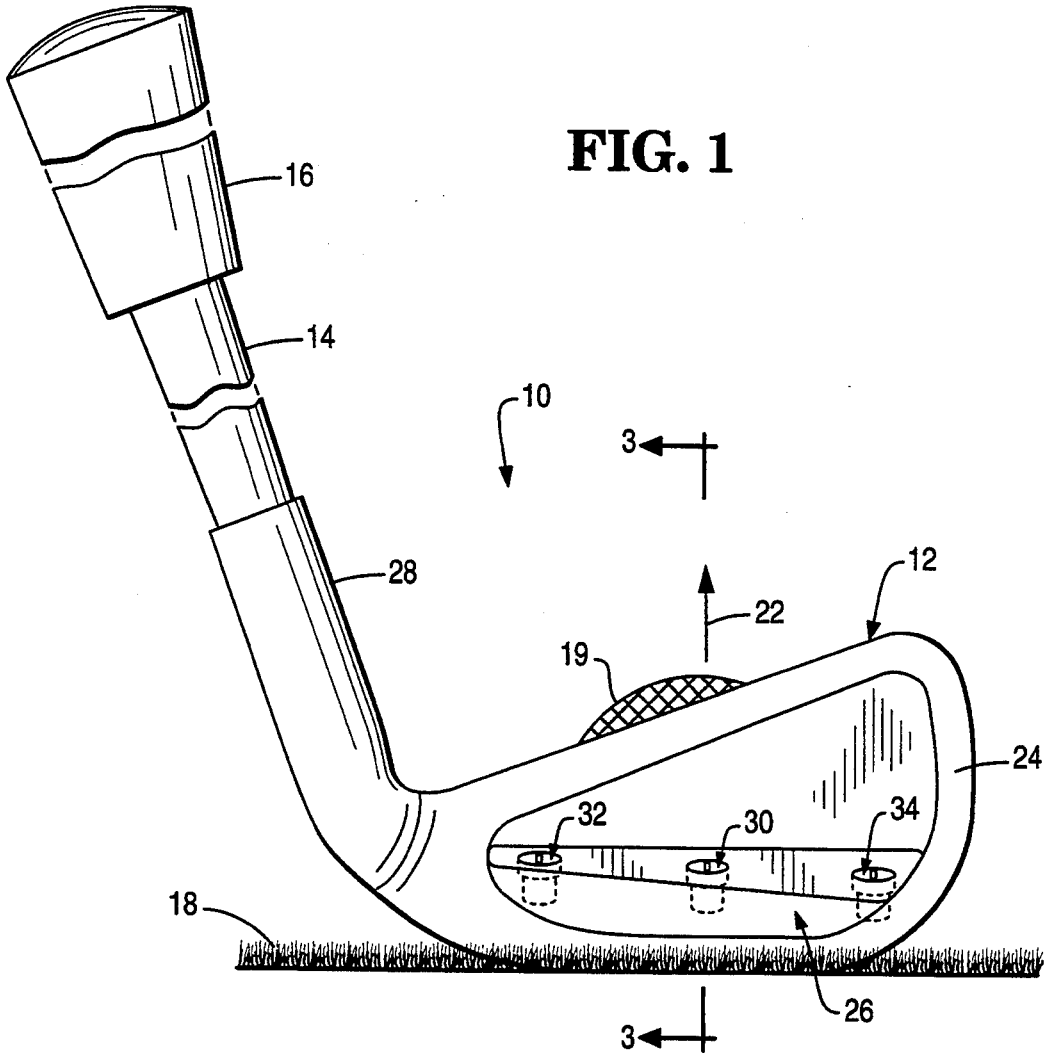
FIG. 1 is a ground level view of golf club made according to this invention and a golf ball, when looking down a target line.
Figure 2:
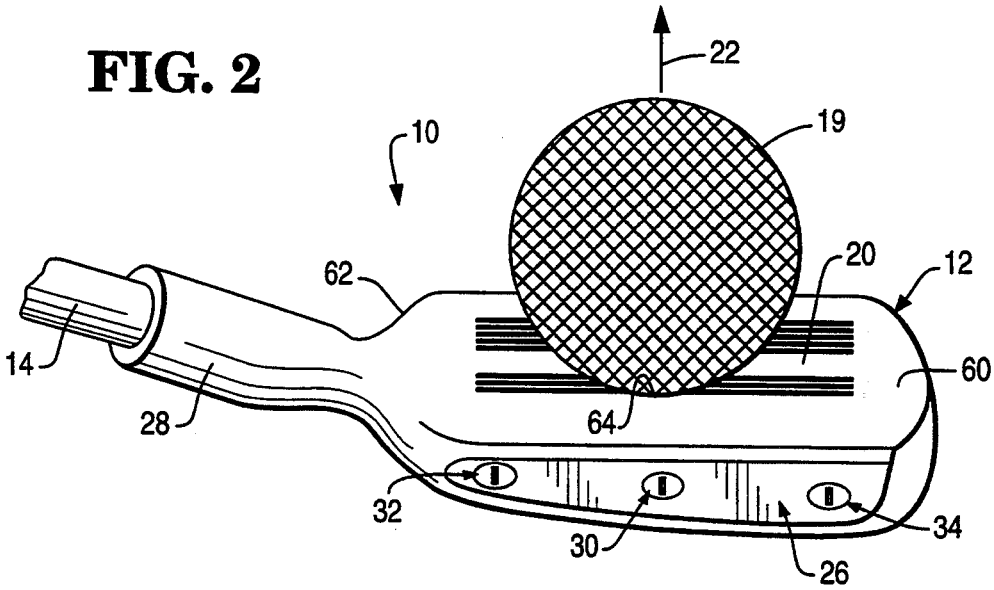
FIG. 2 is a general view of the golf club shown in FIG. 1, as viewed from the perspective of a golfer using the club.

FIG. 1 is a general view of a preferred golf club 10 made according to this invention. The club 10 includes a club head 12, a shaft 14, and a grip 16 which are assembled as shown. The view in FIG. 1 is taken from ground level, showing the club head 12 resting on the ground or fairway 18 while the club head 12 addresses a golf ball 19, with the club face 20 (FIG. 2) being aligned perpendicular to a target represented by an arrow 22. The club head 12 may be of the cavity type, for example, in that it has a perimeter 24 and a receiving area or thickened portion 26 which are opposite to the club face 20. The club head 12 also has a hosel 28 to receive the shaft 14, as shown in FIGS. 1 and 2.

In order to provide flexibility in designing or custom fitting golf clubs for an individual golfer, FIGS. 1–4 show an embodiment in which three replaceable inserts 30, 32, and 34 are located in the thickened portion 26 of the club head 12. Not all three may be necessary for an individual design; however, showing three inserts represents a full range of opportunities presented by the design of the club. While this invention is portrayed with an "iron" golf club, the same techniques could be applied to golf clubs referred to as "woods" (driver and fairway woods), with these clubs being made of wood or metal.

In designing the club 10, one method according to this invention is to design the club head 12 so that the resulting golf club 10 will have a minimum swing weight for a class of clubs. For example, women's clubs might have a swing weight of C5, and the men's clubs may have a swing weight of C8, when using the standard lengths of shafts for the women's clubs and the men's clubs. In general, the standard length of women's clubs is slightly shorter than the standard length of men's clubs. The inserts 30, 32, and 34 would have their minimum weights to enable the resulting set of clubs to have the minimum swing weight of C8 for the mens's clubs mentioned. Additional inserts, like 30, would be available to increase the swing weights of the associated clubs.

Figure 3:
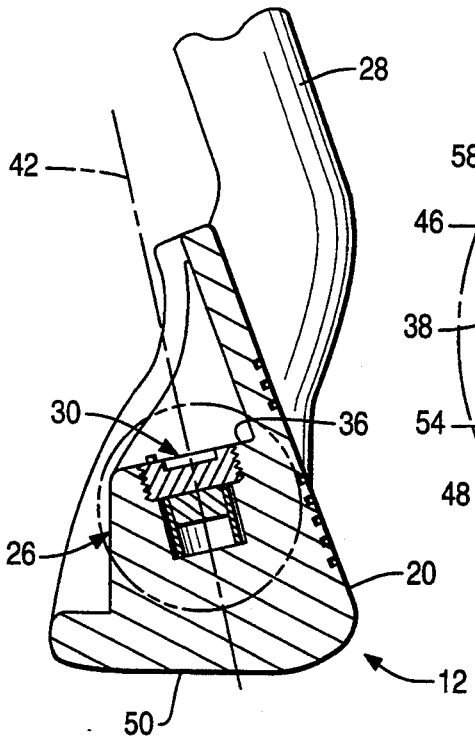
FIG. 3 is a sectional view, taken along the line 3—3 of FIG. 1 to show additional details of replaceable inserts which are included in the club head.
Figure 4:
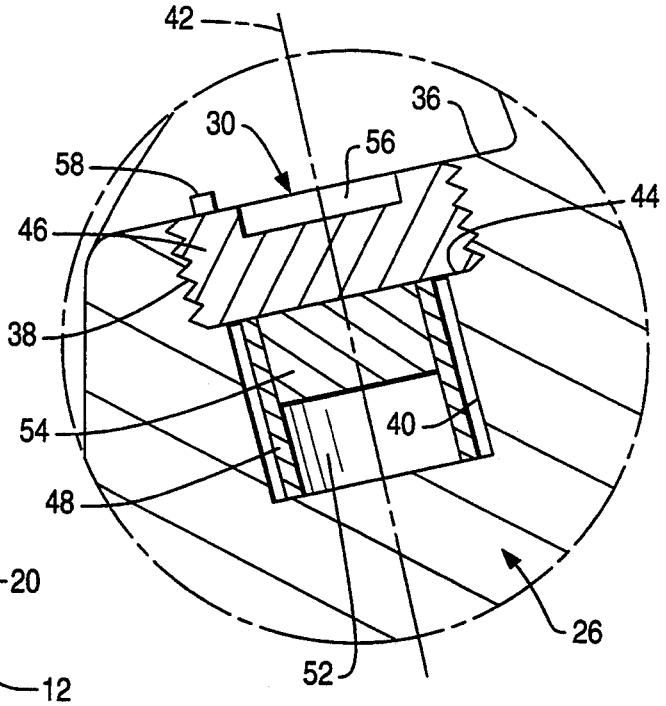
FIG. 4 is an enlarged view of the replaceable insert shown in the circle in FIG. 3.

One embodiment of the insert 30 is shown in FIGS. 3 and 4, for example. The receiving area or thickened portion 26 of the club head 12 is the area which receives the inserts 30, 32, and 34. The thickened portion 26 may have a sloped surface 36, as shown in FIGS. 3 and 4, to facilitate the insertion and withdrawal of the inserts, like 30. The thickened portion 36 has a threaded opening 38 therein, having a first diameter, and also has a recess 40 therein, having a second or smaller diameter than the diameter of the threaded opening 38. The threaded opening 38 and the recess 40 are concentric with the longitudinal axis 42 of the insert 30 and provide a shoulder or seat 44 (FIG. 4) for the insert 30.

The inserts 30, 32, and 34 are essentially all alike; therefore, a discussion of only insert 30 will be given. The insert 30 has a head 46, with external threads thereon, to be threadedly received in the threaded opening 38 in the thickened portion 26. A tubular sleeve 48 depends from the lower side of the insert 30 (as viewed in FIG. 4), and the tubular sleeve 48 provides a receiver 52 into which weighty material 54, like lead, for example, may be located. The insert 30 has a driving recess 56 to receive a screw driver, for example, for installing and removing the insert 30 from the club head 12. The insert 30 also has indicia 58 (shown as a raised area in FIG. 4) to indicate the particular swing weight which the golf club 10 will attain when the insert 30, and perhaps other inserts are inserted in the club head 10 as will be explained hereinafter.

The simplest arrangement is to have just one replaceable insert like 30 (the center insert in FIG. 1) provided in the club head 12. With this approach, the swing weight of the club 10 or set of clubs is designed to have the minimum swing weight for the class of clubs being made. For example, the insert 30 would be designed with no weighty material 54 in the insert 30. With such an insert 30, the club 10 may provide a swing weight of C5, for example, for women's clubs. The inserts 30 for swing weights C6, C7, C8, D0, and D2, for example, would have increasing amounts of weighty material 54 in the associated inserts 30. The indicia 58 on the top of each insert 30 would indicate the swing weight, like C5 or D2 which the club 10 will attain when that particular insert is installed in the club 10. The amount of weighty material 54 to be inserted in each insert 30 can be determined using a standard lorythmic scale which is used by club manufacturers. These scales are also found in many shops selling golf clubs.

An advantage of this invention is that the inventory required to offer the same type of golf club in different swing weights is reduced. At the present time, a shop selling clubs might have to store the same style of clubs in a C8 swing weight, another set in a D0 swing weight, and a third set in a D2 swing weight, for example. A set of golf clubs could be provided with inserts for the minimum swing weight and then a plurality of the different swing weights could be provided to the shops selling the clubs. An inventory of a variety of inserts, like 30, is a lot cheaper to maintain than trying to maintain a set of clubs in a variety of swing weights. The inventory is also reduced for the club manufacturer by this invention.

There are advantages for an individual buying a set of golf clubs made according to this invention. If an individual thinks that he or she wants a set of clubs having a swing weight of D0, for example, the particular inserts 30 can be selected from the group of inserts mentioned to attain this swing weight. Many golf shops have indoor driving ranges which enable a purchaser to try out the clubs prior to purchasing the set. While this is not as good as trying the golf clubs in regular play on a golf course, it is better than nothing. Because multi-weighted inserts, like 30, are available, the individual can feel more confident about buying the set of clubs because he or she knows that the swing weight, if not satisfactory, can be replaced with lighter or heavier inserts 30. As previously stated, it is only through trying a set of golf clubs in regular play on a golf course that an individual begins to feel comfortable with a selection of golf clubs made.

Another advantage to an individual with a set of golf clubs made according to this invention, is that each club within a set can be tailored to have a specific swing weight. At the present time, if one buys a set of golf clubs from a golf shop, all the clubs within the set of clubs have the same swing weight. While it is true that all the clubs have the same swing weight, the swing weight as determined, is obtained as a "static" swing weight through using the lorythmic scale mentioned. The design of clubs is in part a scientific operation, and in part, it is the result of experimentation or an art derived through a "feel" of the club as it is used in normal play. With the clubs of this invention, an individual can determine the desired swing weight for each club. For example a longer #2 iron with a swing weight of D2 may "feel" better to an individual even though the remaining clubs in the set have a swing weight heavier or lighter than D2.

Another advantage of the clubs 10 made according to this invention, is that the location of the weighty material 54 in the insert 30 (FIG. 4) may be changed to affect the swing characteristics of the club 10. For example, some individuals have difficulty hitting the longer irons, like a #3 or a #2 iron, for example. When more weight is placed towards the sole 50 or bottom of a golf club, the individual using the club has a better of chance of getting the ball airborne or getting a ball flight having a higher trajectory than would be the case without this design. With the club 10 of this invention, the weighty material 54 could be located towards the bottom of the tubular sleeve 50 (as viewed in FIG. 4) instead of having the weighty material 54 located in the position shown.

Another advantage of the clubs made according to this invention, is that it is easy to tailor the clubs 10 to correct for defective swings by a golfer using the clubs. For example, many of the clubs available today are toe and heel weighted. This means that there is additional weight located out near to the toe and heel of the club to minimize the errant effects of an off-center hit by the golfer using the club. For example, the club 10 (FIG. 2) has a toe portion 60, a heel portion 62, and a center portion or sweet spot 64 located therebetween. If an individual tends to slice, for example, it means that the flight of the ball, when struck by the golfer, tends to curve to the right of an intended target for a right handed golfer. A left handed golfer "slices" when his ball tends to curve to the left of the intended target after being hit. If a right handed golfer tends to "hook," it means that the flight of the ball tends to curve to the left of an intended target after being hit. It is generally better to cure the fault in the swing of the golfer which produces the "slice" or a "hook" rather than to provide a quick fix or accommodation for the fault; however, the clubs 10 can be altered to "cure" the slice or hook.

In a correctly hit ball, it is useful to recognize that the club face 20 is perpendicular to the target represented by arrow 22 in FIG. 2, providing the swing plane of the club head 12 is also perpendicular to the target at impact with the ball 19. When the club face 20 is slightly open at impact, meaning that it is pointed to the right of the target (arrow 22), a slice will result. The position of the club face relative to the target at impact has a greater effect on the ball 66 than the swing plane mentioned. With the clubs 10 of this invention, the insert 34 which is located near the toe portion 60 can be selected to have a greater weight than the insert 32 located near the heel portion 62. Having greater weight near the toe portion 60 tends to close the open club face by bringing it closer to the square position shown in FIG. 2 during impact with the golf ball. Correspondingly, to cure a hook for a right handed player, the insert 32, located near the heel portion 62 of the club 10, can be selected to have a heavier weight than the insert 34 located near the toe portion 60. For this embodiment, only the inserts 32 and 34 shown in FIG. 1 need be used; however, some experimentation can be performed. If the third insert 30 is also used, it can be used to additionally vary the overall swing weight of the club 10 if desired. When only two inserts 32 and 34 are used, these two inserts would be weighted to provide the minimum swing weight for the set of clubs when presented for sale, for example. Additional inserts would be provided to provide the increased swing weights as mentioned.

After using the change of weights in the toe and heel portions 60 and 62 as discussed, if the individual using the club 10 corrects the defect in his or her swing, the swing weights of the inserts 32 and 34 can be replaced with more normal ones.

Figure 5:
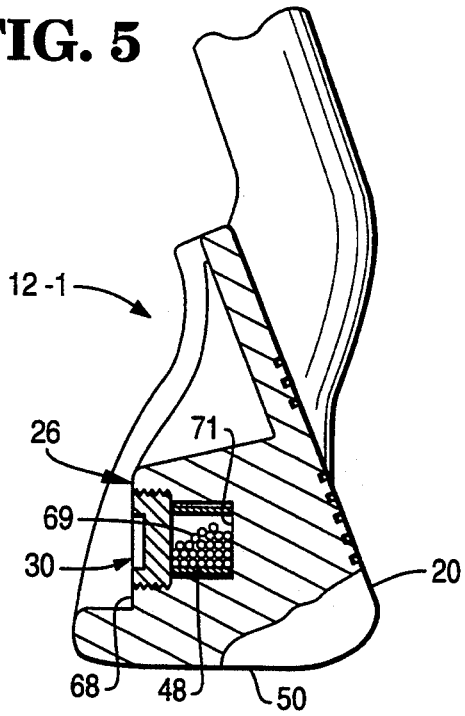
FIG. 5 is a view similar to FIG. 3 to show another embodiment of this invention in which the replaceable inserts are located in a different area of the club head.

FIG. 5 shows a second embodiment of this invention in which the inserts are located in a different position on the thickened portion 26 of the club head 12-1. The club head 12-1 is the same as club head 12 except that the inserts, like 30, are located in the back face 68 of the thickened portion 26. Instead of having weighty as a solid material like 54 shown in FIG. 4, the weighty material could take the form of weighty elements, like steel balls 69, for example, which are located in the tubular portion or sleeve 48. When the club head 12-1 is accelerated forward towards a golf ball, the steel balls 69 would be located at the head 46 of the insert 30. When the club face 20 impacts against a golf ball, the club face 20 begins to decelerate. During this deceleration one can speculate that the steel balls 69 would attain free flight and impact against the area 71, thereby transferring the momentum of the steel balls to the club face 20 to provided an added "kick" to the golf ball. This embodiment might be helpful in designing clubs for toe and heel weight locations and for curing "slices" even though a club having steel balls therein might be noisy and might not satisfy the rules of the associations governing the playing of professional golf. The steel balls 69 could be used as a weighting technique and secured in place with an adhesive or cement if the "kick" feature is not desired.

Figure 6:
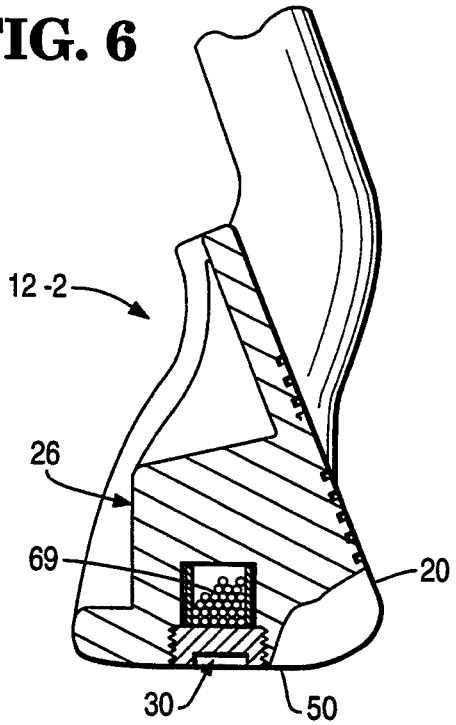
FIG. 6 is a view similar to FIG. 3 to show another embodiment in which the inserts are located in yet another area of the club head.

FIG. 6 shows a third embodiment of this invention in which the inserts are located in the bottom portion or sole 50 of the club head 12-2. The club head 12-2 is the same as club head 12 except that the inserts, like 30, are located in the sole 50 of the club head 12-2. The particular location of the inserts, like 30, is determined by the overall design of the club head to which this invention is applied. The steel balls 69 could be used as a weighting technique and secured in place with a cement or adhesive if the "kick" feature is not desired.

One way of manufacturing the insert 30 (FIG. 4) is to machine it on an automatic screw machine, for example, and thereafter, the driving recess 56 may be cut using a "hopper feed" slotting machine which is used in slotting the heads of machine screws. For this process, the indicia 58 (FIG. 4) would be stamped on the insert 30 by metal punches, for example. Because club heads are made of different materials and techniques, the material selected for the insert 30 may depend upon the material used in the club head. Some club heads are made of cast iron and are then chrome plated. Some club heads are made by a forging process instead of a casting process. Some club heads are made of copper-beryllium or other exotic materials. Having the insert 30 made out of brass or bronze mixtures, for example, makes the machining process relatively simple and inexpensive.

There are several techniques by which the weighty material 54 (FIG. 4) is located in the insert 30. How it is done depends upon the overall design of the club head 12.

If the thickened portion 26 of the club head 12 requires the use of an insert 30 which is short, as measured along its longitudinal axis, then a controlled amount of the weighty material 54, like molten solder, can be poured into an inverted and heated insert 30. Upon cooling, the weighty material 54 is fixed in the insert 30.

Figure 7:
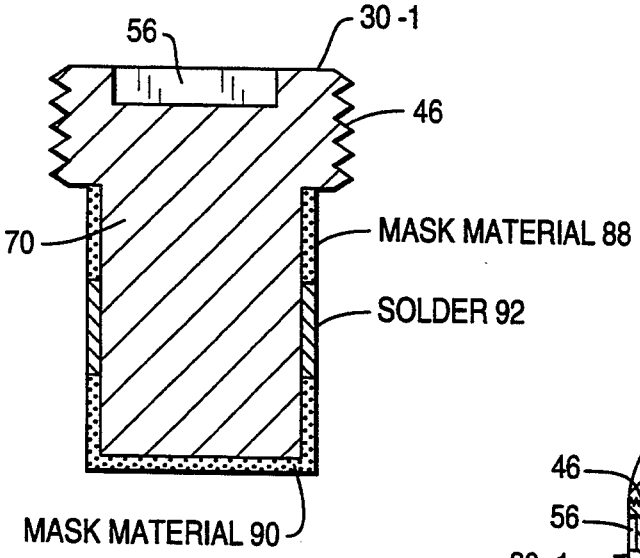
FIG. 7 shows a different embodiment of the insert used with this invention.

If the thickened portion 26 of the club head 12 permits the use of an insert 30 which is long, as measured along its longitudinal axis, then a second embodiment of the insert 30-1 shown in FIG. 7 may be employed. The insert 30-1 has the same head 46 as insert 30; however, there is no tubular sleeve 48, but instead, the insert 30-1 has a solid cylindrical member 70.

Figure 8:
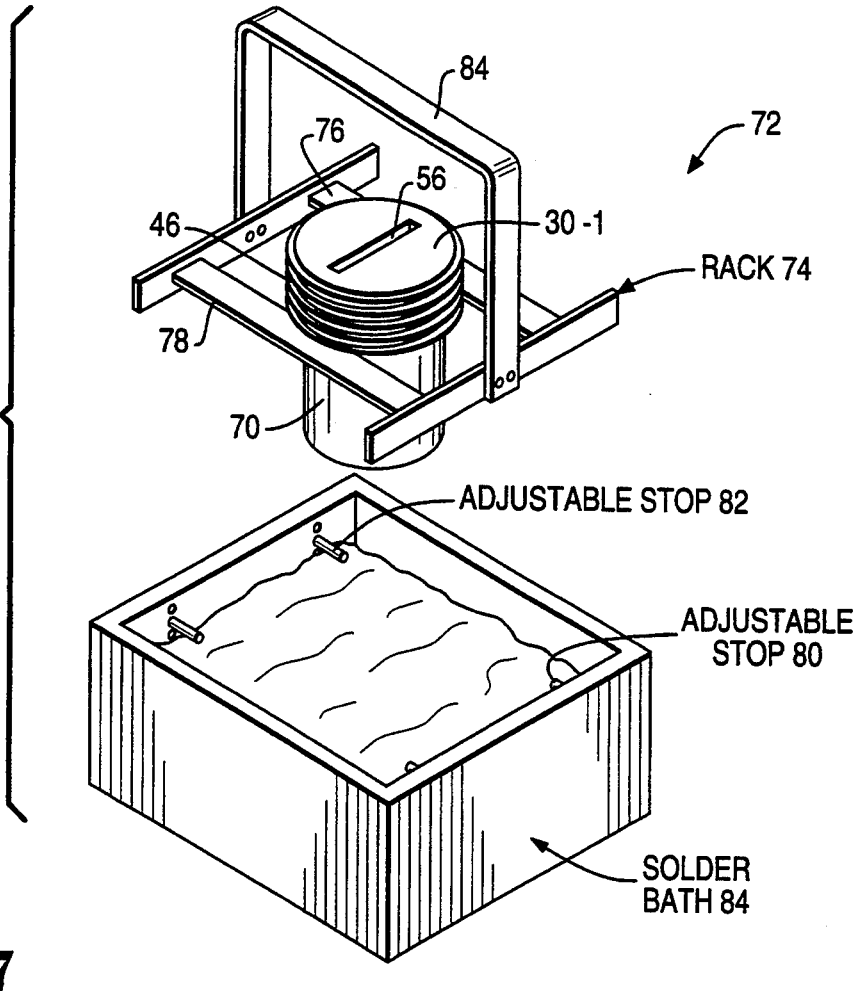
FIG. 8 is an isometric view, in diagrammatic form, showing how weighty material may be applied to the insert shown in FIG. 7, with the view being similar to the view shown in FIG. 4.

In order to increase the weight of the insert 30-1 with a predetermined amount of weighty material, an apparatus 72 shown in FIG. 8 may be used. The apparatus 72 is essentially a rack 74 having spaced apart members 76 and 78 to support the head 46 of the insert 30-1. Naturally, the apparatus 72 would include a plurality of spacer members 76 and 78 so as to support a matrix of inserts 30-1 being processed at the same time; however, only one insert 30-1 is shown in the rack 74 in order to simplify FIG. 8. The apparatus 72 includes conventional, adjustable stops 80 and 82 to support the rack 74, which in turn, enable the insert 30-1 to be positioned at a predetermined depth within a molten solder bath 84. After some experimentation, the amount of weighty material to be applied to the insert 30-1 to obtain the desired swing weight is determined. Thereafter, the immersion depth to which the insert 30-1 must be inserted into the solder bath 84 to obtain the amount of weighty material is determined, and the adjustable stops 80 and 82 are set, accordingly. The rack 74, with the insert 30-1 thereon, is positioned on the adjustable stops 80 and 82 via a handle 84 to immerse the cylindrical member 70 to the desired depth in the solder bath 84. After the insert 30-1 is heated by the solder bath 84 to insure good adhesion by the solder, the rack is removed from the solder bath 84. After cooling. the insert 30-1 may be weighed to make sure that it has the required overall weight from a quality control standpoint. This method is good from the standpoint of being able to reduce an excess amount of solder which may be on the insert 30-1. This can be done by simply scraping off some of the excess solder with a scraping knife.

If the amount of solder on the insert 30-1 has to be very accurately controlled, mask material 88 and 90 (FIG. 7) may be placed on the cylindrical member 70, leaving a band of solder 92 thereon, after the insert 30-1 is inserted in the solder bath 84. Conventional masking techniques may be used for applying the masking material mentioned. The masking can also be performed to place the solder on particular area of the insert 30-1 to solve particular problems in weight location and control.

While FIG. 8 was discussed in relation to a solder bath, the techniques discussed can be used with layers of material other than molten solders. For example quick drying plastics and cold "liquid solder" might be considered.

Figure 9:
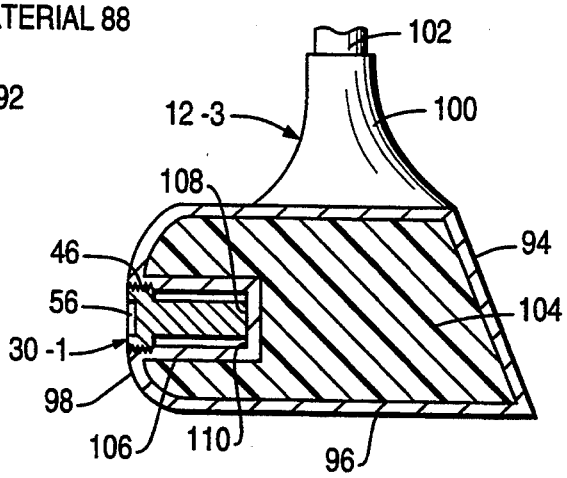
FIG. 9 is a view similar to FIGS. 3 and 5 to show how this invention is applied to a driver or fairway "wood".

FIG. 9 shows how this invention may be extended to a set of clubs referred to as "woods", including a "driver." FIG. 9 is a view similar to FIGS. 3 and 5, for example, and it shows a club head 12-3 of a golf club, with a cross section of the club head 12-3 taken along a line similar to the line 3-3 shown in FIG. 1. The club head 12-3 has a club face 94, sole 96, rear side 98, hosel 100 and a club shaft 102 as shown. The club 12-3 may be made of a metal like aluminum or more exotic materials like copper beryllium or chrome cadmium, for example.

When the club head 12-3 is made of metal, the club is formed by having an external skin, as shown, with the middle of the club head being hollow and being filled with a plastic material shown as 104. The club head 12-3 also has a tubular, cylindrical recess 106 which is threaded to receive the external threads 46 of the replaceable insert 30-1 shown in FIG. 7, for example. The insert 30 shown in FIGS. 3–6 could also be used in the various positions shown in these Figures. It would be preferable to make the length of the insert 30-1, as measured along its longitudinal axis, long enough to enable the end 108 of the insert 30-1, shown in FIG. 9, to abut against the end wall 110 of the recess 106. This will prevent stress on the internal threads on the cylindrical recess 106 and the external threads 46 on the insert 30-1 when the club head 12-3 impacts against a golf ball when traveling at over 100 miles per hour.

What is claimed is:

1. A golf club having a grip, a shaft, and a club head;

said club head having at least one receiving area thereon for receiving a replaceable insert therein;

a group of replaceable inserts having predetermined varied weights; and at least one replaceable insert selected from said group of replaceable inserts and inserted in said at least one receiving area to provide a predetermined swing weight for the club when said at least one replaceable insert is inserted in said at least one receiving area;

said at least one replaceable insert having an amount of weighty material attached thereto, with said amount of weighty material being varied to alter the swing weight of the associated club; and said at least one replaceable insert having a cylindrical section and said weighty material being present in the form of a layer bonded to said cylindrical section.

2. A golf club having a grip, a shaft, and a club head;

said club head having at least one receiving area thereon for receiving a replaceable insert therein;

a group of replaceable inserts having predetermined varied weights; and at least one replaceable insert selected from said group of replaceable inserts having predetermined varied weights and inserted in said at least one receiving area to provide a predetermined swing weight for the club when said at least one replaceable insert is inserted in said at least one receiving area;

said at least one replaceable insert having:

a head portion having a head diameter having external threads thereon;

a cylindrical portion having an external diameter smaller than said head diameter; and a predetermined amount of weighty material located on said cylindrical portion; to enable said at least one replaceable insert to provide one of said predetermined varied weights from said group of replaceable inserts;

said receiving area having threads therein to threadedly receive said head portion;

said weighty material being in the form of a layer;

said cylindrical portion having areas which have mask material thereon to prevent said layer of weighty material from adhering thereto to thereby control the amount and location of weighty material attached to said at least one replaceable insert.

3. The golf club as claimed in claim 2 in which said layer of weighty material is a layer of solder in the form of a band around a periphery of a portion of said cylindrical portion.

4. A golf club having a grip, a shaft, and a club head;

said club head having at least one receiving area thereon for receiving a replaceable insert therein;

a group of replaceable inserts having predetermined varied weights; and at least one replaceable insert selected from said group of replaceable inserts and inserted in said at least one receiving area to provide a predetermined swing weight for the club when said at least one replaceable insert is inserted in said at least one receiving area;

said at least one replaceable insert having an amount of weighty material attached thereto, with said amount of weighty material being varied to alter the swing weight of the associated club; and said at least one replaceable insert having a surface thereon to receive a layer of said weighty material, with said surface having mask material thereon to prevent said layer from adhering thereto to thereby control the amount and location of said weighty material attached to said at least one replaceable insert.

5. A combination of a golf club and a group of replaceable inserts, said golf club comprising:

a grip;

a shaft; and a club head having a receiving area thereon for receiving a replaceable insert;

a first replaceable insert mounted in said receiving area;

said golf club with said first replaceable insert therein having a first predetermined swing weight; and said group of replaceable inserts having a variety of weights to vary said first predetermined swing weight when one of said group of replaceable inserts is mounted in said receiving area;

said first replaceable insert having a weight to enable said club to obtain said first predetermined swing weight which is a minimum swing weight for a group of said clubs comprising a set of clubs; and said group of replaceable inserts having weights to increase the swing weight for a club in said set of clubs;

said weights of said each of said replaceable inserts in said group including an attached weight, with said attached weight being a layer of weighty material being used to alter said first predetermined swing weight; and each said first replaceable insert and each insert of said group of replaceable inserts having a coating area thereon, with said coating area having a controlled amount of said layer of weighty material thereon.

6. The combination as claimed in claim 5 in which each said coating area has mask material thereon to prevent said layer of weighty material from adhering thereto to thereby control the amount and location of said layer of weighty material attached thereto.

7. The combination as claimed in claim 5 in which said golf club has a minimum swing weight for a set of golf clubs and in which each said replaceable insert within said group of replaceable inserts is coded to indicate the swing weight which an individual golf club within said set will attain when the replaceable insert is mounted therein.

8. A golf club having a grip, a shaft, and a club head;

said club head having first and second receiving areas thereon for receiving first and second replaceable inserts therein; and first and second replaceable inserts selected from a group of replaceable inserts having predetermined designated weights and inserted in said first and second receiving areas to provide a predetermined swing weight for the golf club;

said club head having a toe portion, a heel portion, and a face portion having a sweet spot thereon, with said first receiving area located in said toe portion, said second receiving area located in said heel portion, and said sweet spot being located between said toe and heel portions;

said first and second replaceable inserts each having a surface thereon to receive a layer of weighty material, with said surface having mask material thereon to prevent said layer from adhering thereto to thereby control the amount and location of said weighty material attached to said first and second replaceable inserts to provide said designated weights.

9. A method of providing a golf club having a variety of swing weights comprising the steps of:

(a) providing a club head for the golf club with at least one receiving area therein to receive a replaceable insert therein;

(b) providing a plurality of replaceable inserts, with each said replaceable insert having a predetermined amount of weighty material attached thereto for affecting the swing weight of the golf club; and (c) selecting one of said replaceable inserts to be installed in said receiving area to enable the golf club to attain a desired swing weight;

said providing step (b) being effected by:

(b-1) providing a controlled amount of said weighty material by placing a layer of said weighty material on said replaceable insert, and by (b-1-1) masking areas of said replaceable insert to prevent said layer of weighty material from attaching thereto so as to control the amount and location of said layer of weighty material on said replaceable insert.

10. A method of supplying a set of golf clubs comprising the steps of:

(a) providing the golf clubs in the set with a club head having a receiving area thereon to receive a replaceable insert therein;

(b) weighting the set of clubs to have a minimum swing weight when one of said replaceable inserts is inserted therein;

(c) supplying a group of said replaceable inserts having different weights to enable the swing weights of the clubs in said set to be varied, with said supplying step being effected by providing masking material on each said replaceable insert to enable a layer of weighty material to bond to the associated replaceable insert at areas free of said masking material to thereby control the amount and the location of said layer on the replaceable insert;

(d) installing one of said replaceable inserts in said receiving area of an associated club head to enable said clubs in said set to have said minimum swing weight; and (e) removing said replaceable insert of a club from said installing step (d) if the swing weight of the associated club is unsatisfactory and installing a different replaceable insert from said group of inserts in the associated receiving area.

11. The method as claimed in claim 10 in which said supplying step (c) includes the step of:

(c-1) placing indicia on each replaceable insert of said group of replaceable inserts to indicate the swing weight that an individual club in said set will attain if that particular replaceable insert is installed in the receiving area of the associated club head.

12. A replaceable insert for use with a golf club having a club head, with the club head having a receiving area thereon;

said insert having:

a body portion; and a fastener portion for detachably attaching said insert to said club head at said receiving area;

said body portion having a controlled amount of weighty material thereon;

said body portion being in the form of a tubular sleeve to receive said weighty material thereon; and said body portion having mask material thereon to prevent said layer of weighty material from adhering thereto to thereby control the amount and location of said weighty material thereon.

13. The replaceable insert as claimed in claim 12, in which said insert has a swing weight designation thereon to enable a user to select a desired replaceable insert to obtain a desired swing weight for said golf club.

* * * * *